US005359947A

United States Patent [19]

Wagner

[11] Patent Number: 5,359,947

[45] Date of Patent: * Nov. 1, 1994

[54] EQUIPMENT AND PROCESS FOR WASTE PYROLYSIS AND OFF GAS OXIDATIVE TREATMENT

[76] Inventor: Anthony S. Wagner, 13709 Highway 71, West, Bee Caves, Tex. 78738-3112

[ * ] Notice: The portion of the term of this patent subsequent to Dec. 21, 2010 has been disclaimed.

[21] Appl. No.: 103,122

[22] Filed: Aug. 9, 1993

Related U.S. Application Data

[63] Continuation-in-part of Ser. No. 982,450, Nov. 27, 1992, Pat. No. 5,271,341, which is a continuation-in-part of Ser. No. 699,756, May 14, 1991, Pat. No. 5,171,546, which is a continuation-in-part of Ser. No. 524,278, May 16, 1990, Pat. No. 5,000,101.

[51] Int. Cl.[5] ..... F23G 7/04

[52] U.S. Cl. ..... 110/346; 110/235; 110/214; 588/201

[58] Field of Search ..... 110/346, 235–250, 110/204, 214; 588/201

[56] References Cited

U.S. PATENT DOCUMENTS

| | | | |
|---|---|---|---|
| 3,885,507 | 5/1975 | Davy et al. | 110/214 |
| 4,173,190 | 11/1979 | Greenberg et al. | 110/243 |
| 4,246,850 | 1/1981 | Gravel et al. | 110/235 |
| 4,934,286 | 6/1990 | Fowler | 110/346 |
| 5,171,337 | 12/1992 | Pollock | 55/284 |
| 5,199,973 | 4/1993 | Funk | 75/392 |
| 5,271,341 | 12/1993 | Wagner | 110/346 |

*Primary Examiner*—Henry A. Bennet
*Assistant Examiner*—William C. Doerrler
*Attorney, Agent, or Firm*—Joseph F. Long

[57] ABSTRACT

A process and equipment for pyrolyzing packaged waste in a reactive metal alloy in an oxygen deficient atmosphere and separating for recycling the resultant glass, and metal while feeding the resultant off gas containing hydrogen, nitrogen, and carbon to an oxidation unit before either venting to the air directly or venting through an aqueous scrubber.

10 Claims, 5 Drawing Sheets

EQUIPMENT AND PROCESS FOR WASTE PYROLYSIS AND OFF GAS OXIDATIVE TREATMENT

BACKGROUND

This application is a continuation-in-part of Ser. No. 07/982,450, filed Nov. 27, 1992 and entitled "Equipment and Process for Medical Waste Disintegration and Reclamation," now U.S. Pat. No. 5,271, 341 Ser. No. 07/982,450 is, in turn, a continuation-in-part of Ser. No. 07/699,756 filed May 14, 1991 entitled "Waste Treatment and Metal Reactant Alloy Composition" now U.S. Pat. No. 5,171,341 which is a C.I.P. of Ser. No. 524,278, filed May 16, 1990, entitled "A Hazardous Waste Reclamation Process," now U.S. Pat. No. 5,000,101.

This invention encompasses special equipment designed pyrolyze to disintegrate and separate useable materials from both hazardous and non hazardous waste, such as boxed biomedical waste, bagged pharmaceuticals, canister, drums etc. using a reactant alloy composition; off gas from the pyrolysis unit is oxidized to remove carbon and hydrogen. Trace organic compounds should also be oxidized if present.

The pyrolysis vessel of the invention is designed to:

a) heat a mixture of aluminum and other metals designed for a particular waste to produce a molten metal bath;

b) control burners operated with a minimum of combustion air or use induction heating to hold the molten bath above 800° C.;

c) allow moving sealed containers to be automatically dumped into and submerged in the molten bath;

d) have a minimum of oxygen contact with the molten metal bath in the pyrolysis chamber by use of an inert gas purge;

e) subject all exhaust gas from the pyrolysis chamber a minimum of 250° C. temperature;

f) send the pyrolysis chamber off gas through an oxidation chamber to oxidize organics and hydrogen. In a second embodiment off gas from the oxidation chamber is water scrubbed as a precaution to prevent inadvertent atmosphere contamination.

Heating is accomplished either using burners burning methane, propane, butane, etc., or using electrical induction heating.

Above 800° essentially all organic materials, including organic pathogens, are broken down into carbon and gaseous products. Negative ions such as chlorine, bromine, etc., in the organic compounds will react with the alloy and be held as non volatile salts. The carbon, and hydrogen and, in some cases, some oxidizable products from the pyrolysis unit are oxidized in the oxidation chamber. In other embodiments the pyrolysis off gas may be scrubbed to remove carbon ahead of the oxidation chamber. Glass will melt and metal will dissolve or remain in the molten bath. Water in the form of steam will pass into the aqueous scrubber. Normally negative ions such as chlorine will be held by calcium in the alloy; however salts that sublime would be removed in aqueous scrubber in some embodiments.

Periodically, the molten bath must be replaced in order to reclaim the metals. The molten bath may be allowed to drain out of the reactor or pumped into collection vessels for later use in the metal industry. Molten glass may skimmed off the surface of the molten alloy. Air is essentially excluded from the pyrolysis unit and the small amount of air in the waste as charged reacts to oxidize carbon to carbon monoxide or dioxide.

SUMMARY OF THE INVENTION

The invention comprises equipment and process to pyrolyze packaged hazardous toxic and non toxic waste such as biomedical waste in an atmosphere containing a minimum of oxygen and to oxidize hydrogen and carbon in the pyrolysis off gas in an oxidation chamber. Pyrolysis is carried out in a molten alloy bath. The alloy is heated to above 800° C. either by induction heating or by gas burners. A preferred embodiment comprises a two compartment pyrolysis unit with an underflow of a molten reactive alloy from a first firebox compartment into a second compartment wherein the packaged waste, with the preferred package being a sealed box or container, is submerged in the molten alloy in such a fashion that pyrolysis products come into intimate contact with the molten alloy. In a high through put unit dual fire boxes may be used. All the pyrolysis products must be heated to a minimum of 250° C. by contact with the alloy, off gas electrical heaters, and/or the brick lining of the chamber in order to destroy all pathogens. The off gas oxidation provides a further safeguard. A dunking system with a ceramic coated plunger acts to submerse the package at the instant the waste package drops into the molten alloy. The face of the plunger is preferably serrated in both directions to form narrow paths for the gaseous pyrolysis products to flow through the molten metal. The plunger is designed and operates to submerse the package, which crushes as it is submerged, to at least ½ inch below the molten alloy level.

In the pyrolysis chamber, glass products will melt and float on the surface. Stainless steel such as hypodermic needles and metal canisters will sink into and be dissolved in the molten alloy. Organic products such as towels, chemicals, etc., will break into their component elements with chloride, bromides, etc., reacting to form non-volatile compounds with calcium in the alloy. Elemental carbon will be carried off in the off gas with gaseous nitrogen and hydrogen.

Instrumentation is provided to make certain that the off gas is heated to a minimum of 250° C., which destroys all pathogens. In a preferred embodiment the off gas goes through an oxidation chamber before being scrubbed in an recirculating aqueous scrubber.

Chlorine may be added to the circulating water in an amount to hold a residual chlorine of about one part per million as a precautionary measure to prevent pathogen leakage due to misoperation of both the pyrolysis unit and oxidation chamber.

DETAILED DESCRIPTION OF THE DRAWINGS

The invention may be best described from the drawings.

Figure 1:
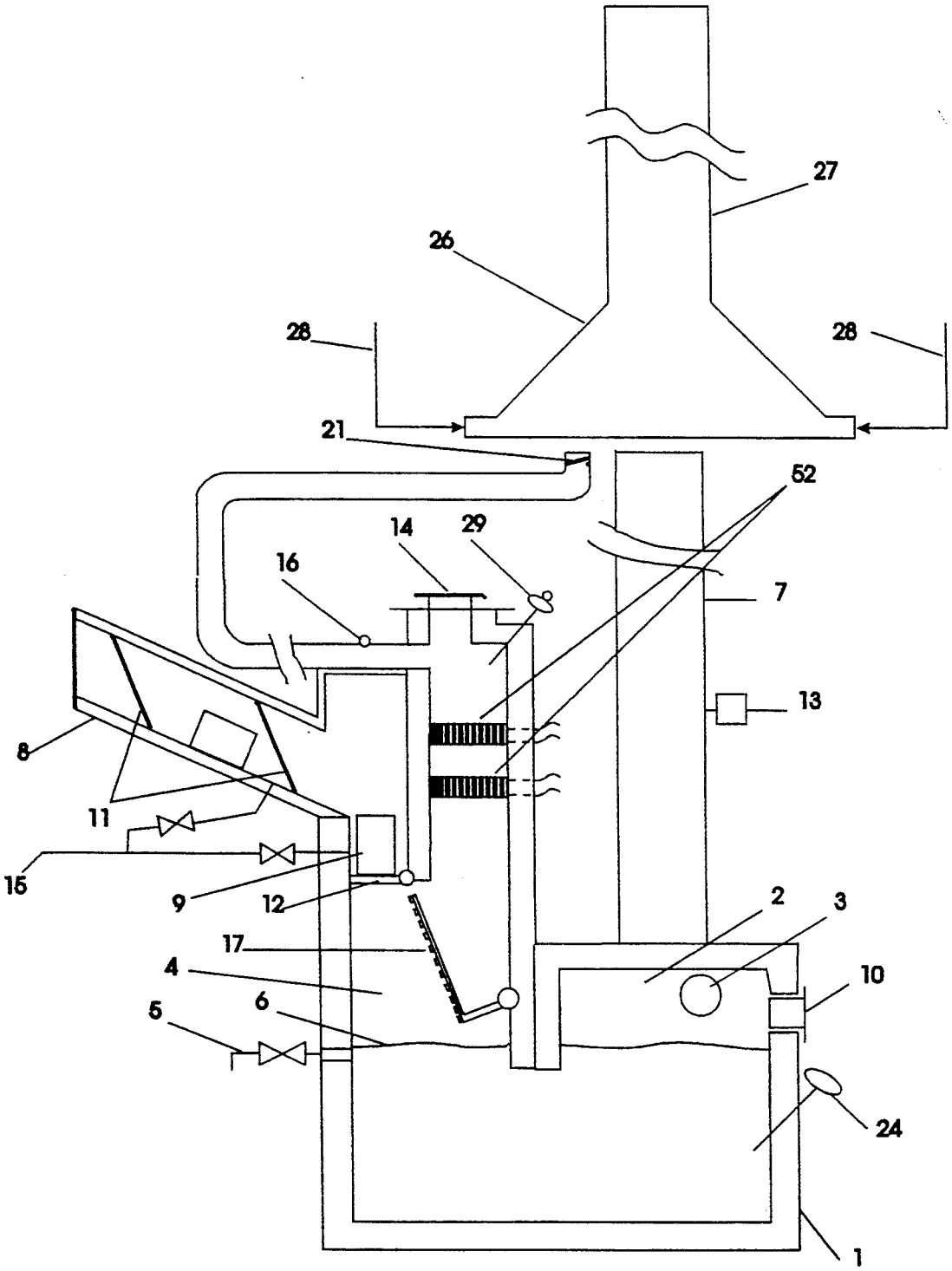
FIG. 1 shows the pyrolysis unit and one type of oxidation chamber.

In FIG. 1 we show a section view of a preferred embodiment of the off gas oxidation stack 27 and the brick lined pyrolysis unit 1. The preferred outer metal shell is a high melting stainless steel. The pyrolysis unit 1 may also be lined with a high temperature refractory material or fabricated from special metal alloy. In the pyrolysis unit 1 the first compartment of firebox compartment 2 is heated by the burner 3. Burner 3 heats alloy metal charged through port 10 to form a molten alloy held am level 6. Molten alloy underflows the baffle between the two compartments into the second or pyrolysis compartment 4.

Figure 3:
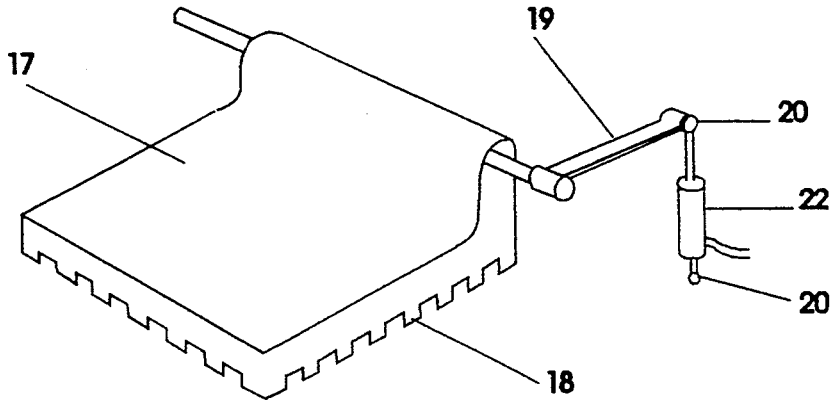
FIG. 3 shows a detail of a plunger unit in the pyrolysis unit.

The alloy composition may be varied as follows for particular type wastes:

Aluminum 50–99 percent
Calcium 0–20 percent
Zinc 0–50 percent
Iron 0–50 percent
Copper 0–50 percent The waste charging unit 8 is designed to receive one or more biomedical waste containing boxes or packages 9 above dump door 12. Dump door 12 may be hydraulically activated. With dump door 12 closed and after charge door it is closed an inert gas purge 15 is opened to maintain a slight positive pressure in the charging unit 8. Carbon dioxide may be used for the inert gas purge. In some installations flu gas may be used for inert gas purge. A hydraulic drive (not shown) for dump door 12 may interlocked with hydraulic drive 22, FIG. 3 for plunger 17. After dump door 12 is opened plunger 17 moves downward to submerse box or package 9 into the molten metal. The box 9 will crush but will be totally under plunger 9, which preferably is sized to loosely cover the area in compartment 2. The plunger 9, in a preferred embodiment, is steel covered with ceramic and has a waffled face 18 as shown in FIG. 3. The hydraulic driver 22, FIG. 3 is controlled to submerse the waffled face 18 a minimum of ½ of an inch to insure all products of decomposition come into intimate contact with the molten alloy thereby being heated above the 250° C. which insures destruction of any pathogens. Temperature sensor 29 which in preferred embodiment leads to a recorder on the control panel 56, FIG. 6, indicates when changes are needed to assure a pathogen destruction temperature. It may be necessary to slow the feed rate or increase the alloy temperature. The boxes 9 are shown as manually fed but automatic feed equipment that could be properly interlocked by automating opening and closing of charge door 11 is well known and would be within the purview of the invention.

Inspection port 10 would preferably be bolted closed, but removable for clean out of possible carbon build up. Drain line 5 would be electrically heated to allow drawing off molten glass that accumulates on the alloy surface. Alternatively, a clean out door to allow manual skimming of the molten glass could be used..

Figure 6:
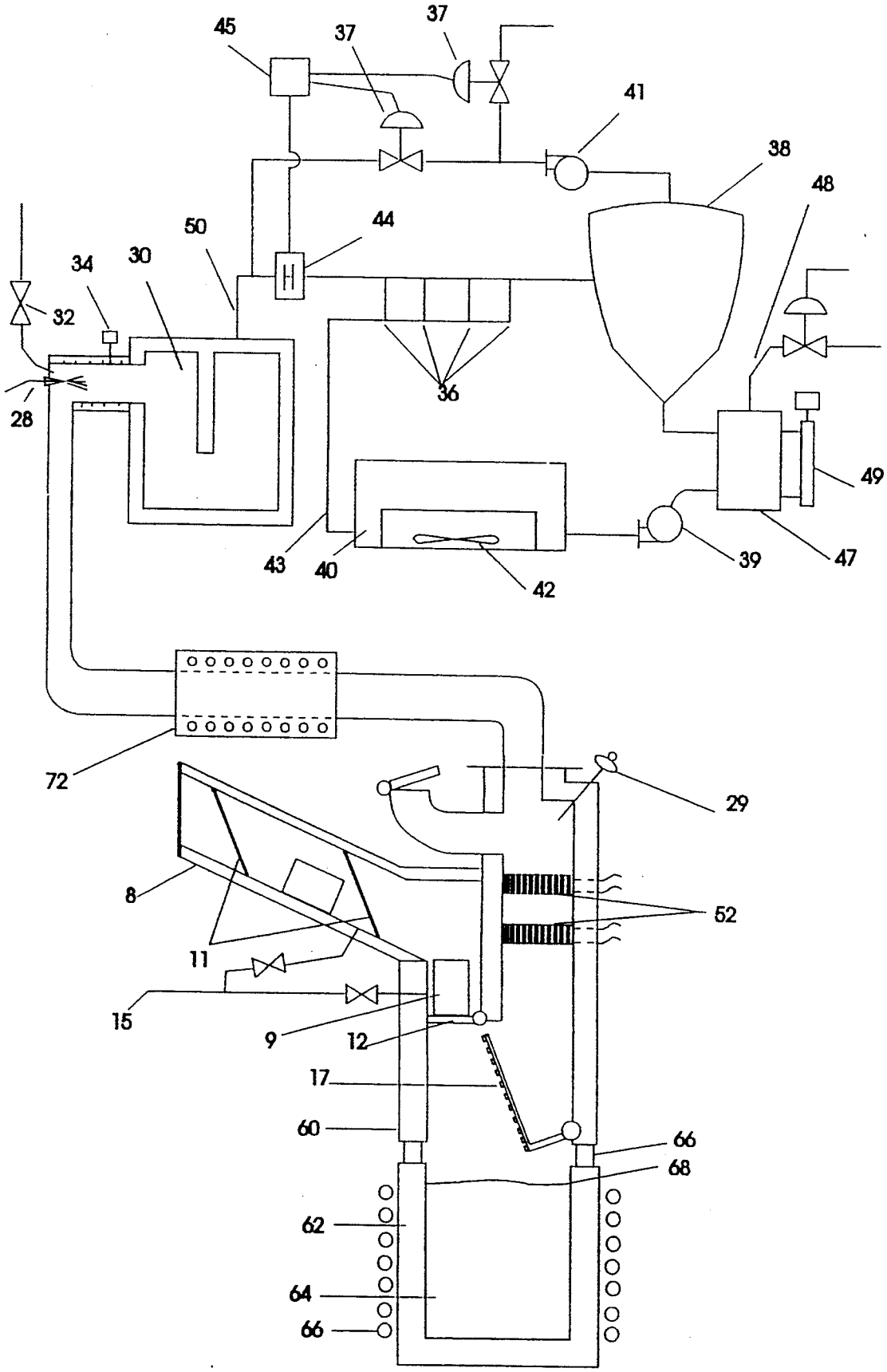
FIG. 6 shows a inductance heated pyrolysis unit with a pyrolysis off gas oxidation chamber ahead of an aqueous scrubber.

Oxygen analyzer 13 indicates oxygen in the stack gas on recorder 60, FIG. 6, and should be held at essentially zero to minimize slag formation in the alloy heating compartment. Charcoal or carbon could be fed into compartment 1 to minimize slag build up by reduction of aluminum oxides.

After submersion of a package 9 below alloy surface 6 by plunger 17 disintegration and breakdown of the waste materials to elements occurs rapidly. The oxygen in the relatively small amount of air in the waste package is consumed to from carbon oxides. The off-gas from the reaction flows through electrically heated grids 4 that are maintained at 300° to 600° C. and out through off gas line 16. A flapper type relief valve 14 provides a large area to relieve pressure in case a package with a large amount of liquid is inadvertently fed into the unit. Off gas line 16 exits below cowling 26 of oxidation stack 27. Dual burners 28 or a ring burner arrangement is used to provide a continuous source of ignition for the exit gas - air mixture aspirated into oxidation stack 27 by the heated air from off gas line 16 and from stack 7 from the firebox 2. The cowling shape and physical disconnect formed as shown assures ample air for combustion of carbon, hydrogen, and possibly other combustibles exiting line 16. A back flow preventer 21 assures positive pressure in line 16 since there is a small continuous inert gas purge through line 15.

Figure 2:
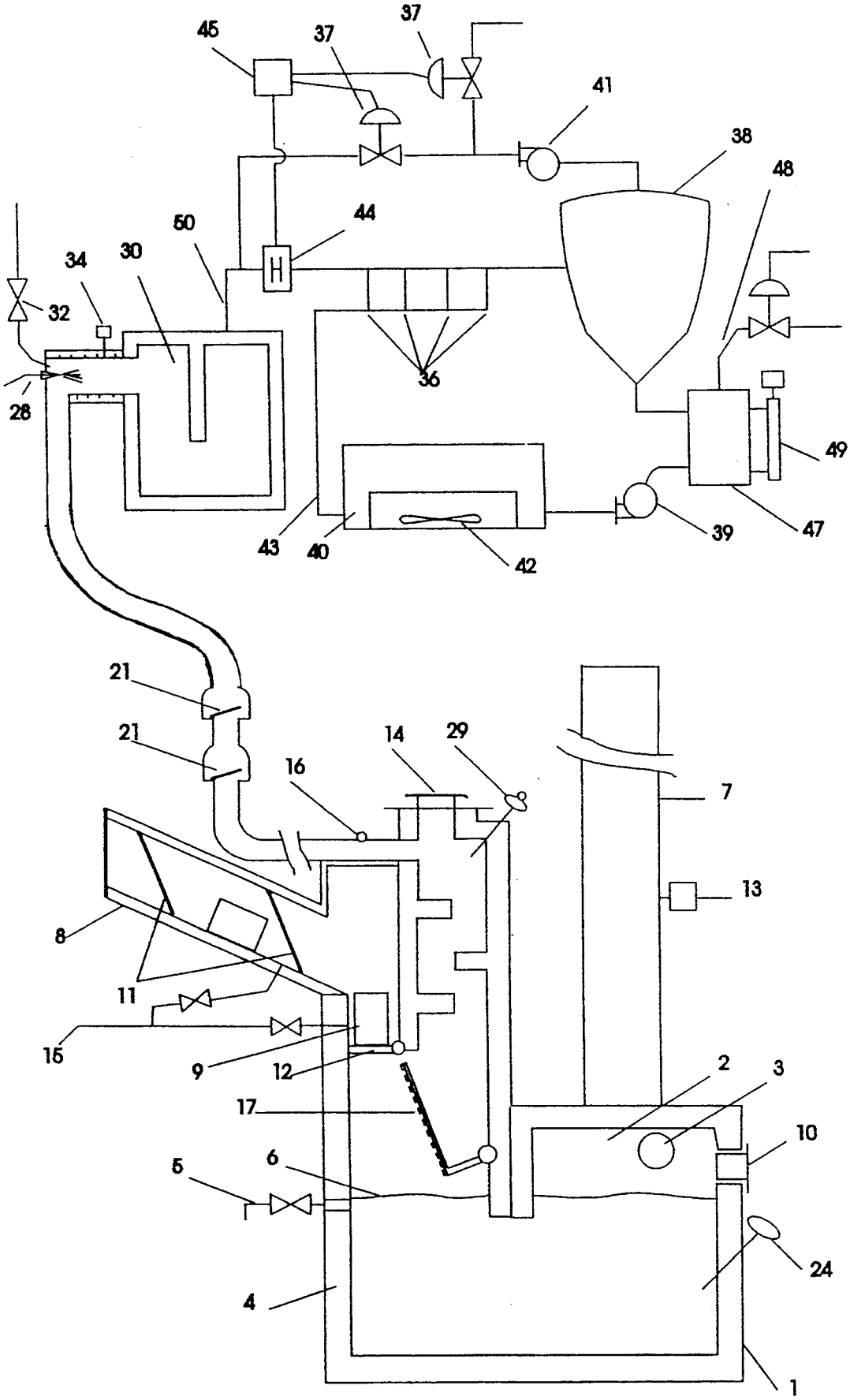
FIG. 2 shows a second embodiment of the invention wherein the pyrolysis unit off gas travels through on oxidation chamber to remove carbon and hydrogen prior to scrubbing.

In FIG. 2 we've shown another embodiment of the invention wherein the pyrolysis feed system and pyrolysis unit are as described in FIG. 1. The pyrolysis unit off gas flows through line 16 through a dual flapper valve arrangement 21 to prevent back flow. These valves may not seat perfectly and a continuous inert gas purge through line 15 is maintained to assure back flow prevention. Off gas line 16 ties into the inlet of combustion or oxidation chamber 30 with the flow mixing with air aspirated in through line 32. A pressure gage and controller 43 adjusts control valves 37 through controller 45 to maintain a maximum of about 0.1 inch of water negative pressure in oxidation chamber 30 by adjustment of valves 37. Other known engineering designs will also achieve this small negative pressure in the oxidation chamber. Burner 28 may be natural gas, propane, etc. and is sized larger than a normal pilot light to assure a continuous ignition source.

The oxidation off gas line 50 is sloped toward the cyclone separator type scrubber 38. Out put from a gas flow measurement instrument also feeds into controller 45 to adjust control valves 37 to recycle sufficient gas through recycle blower 41 for proper operation of the cyclone separator 38. Water spray nozzles 36 are sized to give water flow to cool exit gas to about 100° C. to minimize the steam plume in the vent gas. Exit water from cyclone 38 flows into hold up tank 47. Level controller 49 controls make up water flow 48 to hold a level in the tank 47. Recycle water pump 39 pumps water through cooler 40 ahead of spray nozzles 37 and is activated by air cooler fan 42. Most any type water cooler would be sufficient in this service. Cooler exit line 43 leads to multiple spray nozzles 36.

In FIG. 3 we show more detail of plunger 17 with a waffled ceramic face 18. Arm 19 is external to the pyrolysis unit and is positioned by hydraulic cylinder 19 through a normal type controller (not shown).

Figure 4:
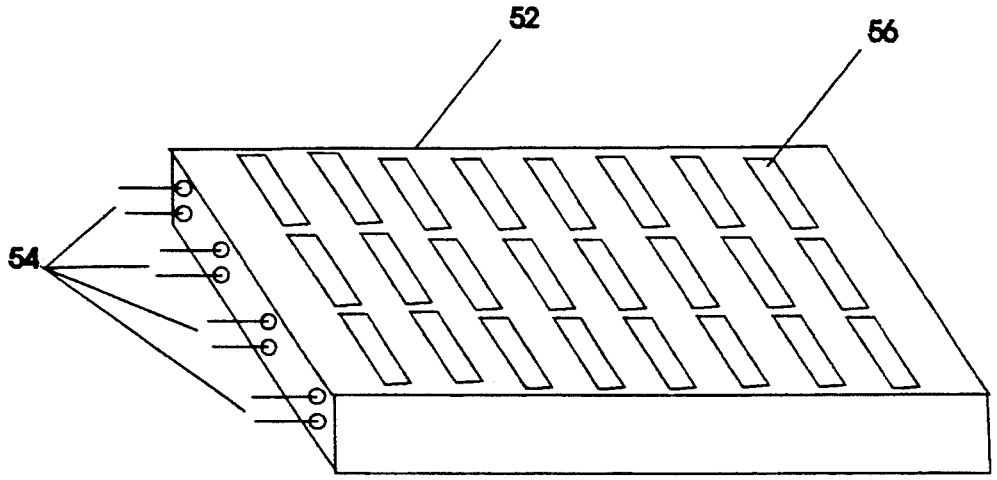
FIG. 4 shows detail of on electrically heated baffle in the pyrolysis unit off gas.

FIG. 4 shows the perforated ceramic grid 52 with openings 56 aligned to allow casting heaters 54 into the ceramic grid. The grid may be about 3 inches thick with seventy-five percent or more open space. A minimum of two grids are used to assure total gas contact. The electrical heaters 54 should hold the grid at 300° to 900° C.

Figure 5:
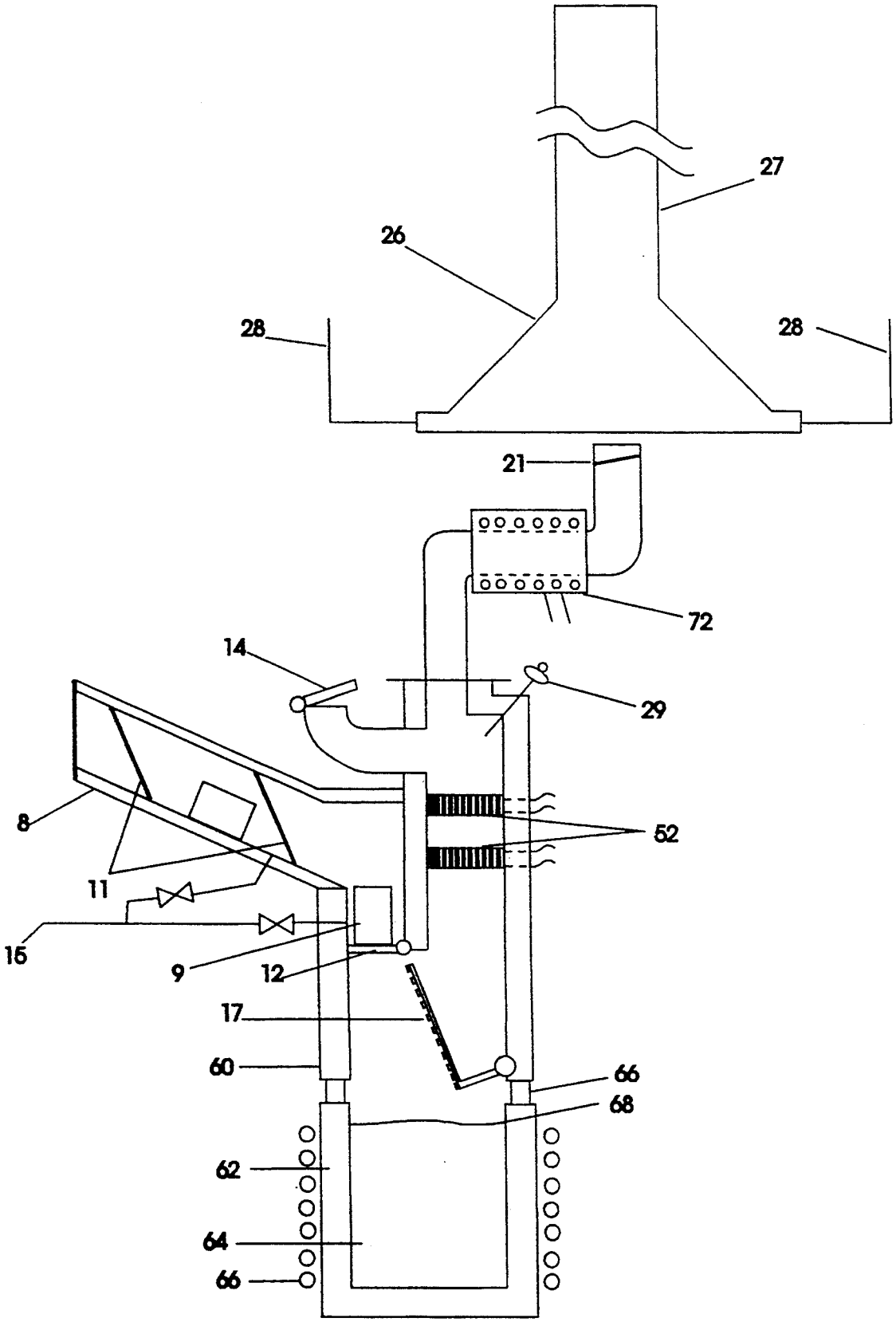
FIG. 5 shows an inductance heated pyrolysis unit and on off gas oxidation unit.

Another embodiment of the invention is shown in FIG. 5. In this embodiment of pyrolysis unit 60 the molten alloy bath 64 is contained in a castable ceramic unit 62 heated with an induction heater 66. The unit 62 is preferably cylindrical in shape but many other shapes are workable; an oblong unit has been shown to cause a magnetic circulation of the molten alloy.

Electrically insulating spacers 66 separate the alloy bath from the upper part of the unit which is preferably a high temperature steel, refractory lined.

In charge chute 8 charge doors 11 and dump gate 12 are operated to allow inert gas purging through line 15 of the chamber containing waste package 9 so that waste packages may be dumped to alloy surface 68 with admission of only the air in the waste package 9.

Plunger 70 which may be metal covered with a castable ceramic and have a waffled surface is shaped to fit relatively closely into ceramic unit 62. Plunger 70 may be hydraulically operated and interlocked with dump gate 12 to submerge package 9 as soon as package 9 hits surface 68.

Off gas from the pyrolytic decomposition, which will contain carbon, hydrogen, water and perhaps a small quality of steam distillable organic formed before total immersion will pass through the ceramic grids 52 that are electrically heated to 300° to 900° C. and will exit through off gas line 16 which in this and the other embodiments may be heated to 800°-900° C. by induction heater 72. A flapper type valve 22 may be used as a back flow preventer. This simple valve should work well since a continuous inert gas flow into the unit through line 15 should be maintained.

Off gas exit line 16 will aspirate and mix with air in cowling 26. Burners 28 in cowling 26 provide a continuous source of ignition and also serve to help maintain continuous flow of air through oxidation stock 27.

In FIG. 6 we show an embodiment of the invention wherein the pyrolysis unit 60 as described under discussion of FIG. 5 leads into oxidation chamber 30 and to cyclone separation scrubber 38 as described under description of FIG. 2.

Figure 7:
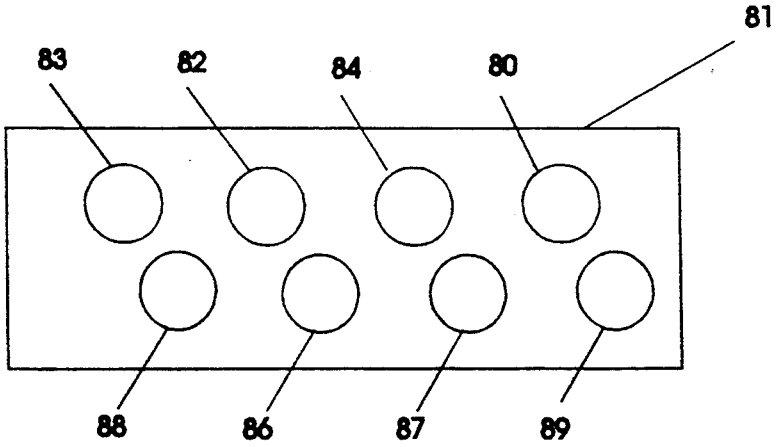
FIG. 7 shows a control panel for the units.

In FIG. 7 we show the control panel 81. In a preferred embodiment all instruments on the panel give both a visual and recorded readout. Burner control 83 controls fuel flow to the burner 3, FIG. 1 and FIG. 2 and inlet air flow is adjustably ratioed to the fuel flow. Burner control 83 is automatically adjusted to maintain a molten metal temperature 88 of about 850° C. A setting of a minimum of 850° C. is preferred as any calcium carbonate formed by reaction of carbon dioxide with calcium in the alloy decomposes at this temperature. Dumper control 82 and plunger control 84 are interlocked so that plunger 17 is in a raised position before dumper gate 12 is opened by operation of an electrical switch (not shown) but located on Unit 1 and other embodiments. The switch may be manually operated or operated by an automatic feed system which is also not shown, but easily designed. Gauge 80 indicates oxygen in the stack gas and should be held very close to zero percent by adjustment of the fuel air mixture ratio. Gauge 82 indicates spray nozzle pressure and may be interlocked with fuel flow to shutdown the unit if, for any reason, the water flow to the spray nozzles 36, FIG. 2, and FIG. 7 ceases. This prevents unscrubbed gas from going to the atmosphere. Pyrolysis exit gas temperature 86 provides a record to indicate that all off-gas from the pyrolysis reaches a minimum temperature of 250° C. to make certain all pathogens are destroyed.

Gauge 89 indicates pressure in combustion chamber 30, FIGS. 2 and 6.

What is claimed is:

1. Equipment and process for waste pyrolysis and off gas oxidative treatment comprising:

a) a refractory lined chamber;

b) a reactive metal alloy in said refractory lined chamber;

c) a heating means to heat said reactive metal alloy in said refractory lined chamber to a minimum of about 800° C. to form a molten alloy mass;

d) a feeding chute means to feed said waste to a surface of said molten alloy mass;

e) a plunger means in said refractory lined chamber to submerse said waste in said molten alloy mass;

f) a back flow prevention means in an exit line from said refractory lined chamber;

g) an oxidation chamber connected to said exit line upstream from said back flow prevention means;

h) a burner means and inlet air line in a beginning end of said oxidation chamber, said burner means supplying continuous ignition to burn oxidizable components in said off gas as said off gas is mixed with said inlet air in said oxidation chamber and;

i) an aqueous scrubbing means connected with an exit line from said oxidation chamber to scrub off gas from said oxidation chamber before said off-gas is vented to the atmosphere.

2. Equipment and process for waste pyrolysis and off gas oxidative treatment as in claim 1 wherein said heating means is an induction heater.

3. Equipment and process for waste pyrolysis and off gas oxidative treatment as in claim I wherein said heating means is a minimum of one burner.

4. Equipment and process for waste pyrolysis and off gas oxidative treatment as in claim I further comprising a minimum of one perforated plate heating means with internal electrical heaters to heat said perforated plate to a minimum of 300° C.; said perforated plate being located in a top portion of said refractory lined chamber to further contact said off gas before said off gas exits said chamber.

5. Equipment and process for waste pyrolysis and off gas oxidative treatment as in claim 1 further comprising an induction heater in said off gas line.

6. Equipment and process for waste pyrolysis and off gas oxidative treatment:

a) an equipment means to pyrolyze said waste in an inert atmosphere and separate gaseous pyrolysis products from metals and glass; said equipment means comprising:

a) a refractory lined chamber;

b) a reactive metal alloy in said refractory lined chamber;

c) a heating means to heat said reactive metal alloy in said refractory lined chamber to a minimum of 800° C. to form a molten alloy mass;

d) a feeding chute means to feed said waste to a surface of said molten alloy mass;

e) a plunger means in said refractory lined chamber to submerse said waste in said molten alloy mass;

f) a back flow prevention means in an exit line from said refractory lined chamber;

g) an oxidation stack with an open cowling means on a lower end of said stack; said cowling means being located above an exit end of said exit line and acting to aspirate air and mix with off gas from said exit line;

h) a minimum of one ignition burner in a lower portion of said cowling means; said ignition burner acting to continually furnish ignition to oxidize combustible components of said off gas.

7. Equipment and process for waste pyrolysis and off gas oxidative treatment as in claim 6 wherein said heating means is an induction heater.

8. Equipment and process for waste pyrolysis and off gas oxidative treatment as in claim 4 wherein said heating means is a minimum of one burner.

9. A process for waste pyrolysis and off-gas oxidative treatment comprising:

a) heating a reactive alloy means in a first chamber of pyrolysis unit to a minimum of 800° C. to form a molten liquid;

b) submersing a package of said waste in said molten liquid with submersing means so designed that pyrolysis products from pyrolysis of said package are heated a minimum of 250° centigrade;

c) feeding off gas from said pyrolysis unit to an oxidation unit;

d) scrubbing products exiting said oxidation unit in a recirculating aqueous scrubber;

e) venting scrubbed gases from said aqueous scrubber through a blower to maintain a negative pressure in said oxidation unit, said scrubber, and said pyrolysis unit.

10. A process for waste pyrolysis and off gas oxidative treatment as in claim 6 further comprising an inert gas feed means to purge air from said feeding chute means and said refractory lined chamber.

* * * * *